US010875547B2

(12) United States Patent
Messaoud et al.

(10) Patent No.: US 10,875,547 B2
(45) Date of Patent: Dec. 29, 2020

(54) DEVICE FOR SUPPORTING AND GUIDING AN AERIAL CARRYING-HAULING CABLE BY MEANS OF DAMPENED SHEAVES

(71) Applicant: POMA, Voreppe (FR)

(72) Inventors: Salah Messaoud, Brézins (FR); Adrien Vincent, Saint-Martin d'Hères (FR); Clémence Seve, Saint Laurent du Pont (FR)

(73) Assignee: POMA, Voreppe (FR)

( * ) Notice: Subject to any disclaimer, the term of this patent is extended or adjusted under 35 U.S.C. 154(b) by 182 days.

(21) Appl. No.: 15/902,312

(22) Filed: Feb. 22, 2018

(65) Prior Publication Data

US 2018/0265099 A1 Sep. 20, 2018

(30) Foreign Application Priority Data

Mar. 14, 2017 (FR) ..... 17 52052

(51) Int. Cl.
*B61B 12/02* (2006.01)

(52) U.S. Cl.
CPC ..... *B61B 12/026* (2013.01); *B61B 12/02* (2013.01)

(58) Field of Classification Search
CPC ..... B61B 12/00; B61B 12/02; B61B 12/026; B61B 12/028; B61B 12/04; B61B 12/12; B61B 12/122
See application file for complete search history.

(56) References Cited

U.S. PATENT DOCUMENTS

2013/0319280 A1* 12/2013 Wieser ..... B61B 7/02 104/112

FOREIGN PATENT DOCUMENTS

| | | | |
|---|---|---|---|
| EP | 1081009 | A1 | 3/2001 |
| FR | 2654053 | A1 | 5/1991 |
| WO | 2012/085883 | A2 | 6/2012 |

* cited by examiner

*Primary Examiner* — Robert J McCarry, Jr.
(74) *Attorney, Agent, or Firm* — Oliff PLC

(57) ABSTRACT

Device for supporting and guiding an aerial carrying-hauling cable of a cable lift installation, said device including a beam supporting a plurality of rotary sheaves designed to press on the cable to guide it when it is running, each rotary sheave being associated with a damping connection articulated around a pivot to form an individual module fixed individually to the beam, the different individual modules being staggered at regular intervals along the beam.

7 Claims, 4 Drawing Sheets

DEVICE FOR SUPPORTING AND GUIDING AN AERIAL CARRYING-HAULING CABLE BY MEANS OF DAMPENED SHEAVES

BACKGROUND OF THE INVENTION

The invention relates to a device for supporting and guiding an aerial carrying-hauling cable of a cable lift installation, said device comprising a support structure, a plurality of rotary sheaves designed to press on the cable to guide it when it is running, and damping means connected to the sheaves to adjust to the deflection and load of the cable.

STATE OF THE ART

In transport installations of chairlift or gondola lift type, the carrying-hauling cable is guided and held by a plurality of sheaves arranged on support sheave assemblies and compression sheave assemblies, which are supported by pillars located between the loading and unloading terminals. Chairs or cars are fixed to the cable by fixed or detachable clamps. The sheaves are associated in known manner in pairs, being mounted on the ends of primary sheave assemblies which are articulated in their middle part on the end of secondary sheave assemblies, themselves mounted in the same way on tertiary sheave assemblies, and so on depending on the number of sheaves used. The last sheave assembly forms a beam mounted articulated in its middle part on a support bracket of the support structure of the pillar. Such a standardized arrangement enables the sheaves to follow the running path of the cable with a homogenous distribution of the load on the sheaves, regardless of the state of load.

In case of a breakdown or of maintenance operations, it is necessary to dismantle the whole of the sheave assembly system. This known technology based on sheave assemblies results in high installation, troubleshooting and maintenance costs, in particular as far as operating time, tooling and hoisting means for assembly or disassembly are concerned.

OBJECT OF THE INVENTION

The object of the invention consists in providing a device for supporting and guiding an aerial carrying-hauling cable, having a simplified structure, and that is easy to install and to maintain so as to reduce intervention time and maintenance costs.

The device for supporting and guiding according to the invention is characterized in that each rotary sheave is associated with a damping connection articulated around a pivot to form an individual module fixed individually to the support structure, and that the different individual modules are staggered along the support structure in the form of a beam.

According to one feature of the invention, the damping connection of each sheave is formed by at least one spring extending in the longitudinal direction of the beam.

According to a preferential embodiment, the beam comprises a profile of reverse U-shaped transverse cross-section having two vertical wings parallel to one another so as to delimit a compartment for housing the different individual modules. The sheave of each module is mounted rotating freely around a first axis on one of the ends of the corresponding damping connection, the other end of said connection being articulated on the pivot which is fixed transversely to the two wings of the profile.

The damping connection of each module comprises for example a pair of leaf springs located symmetrically on each side of the sheave. The intermediate part of each leaf spring presses on a second fixed axis which is parallel to the pivot.

The beam can be mounted fixed or articulated on the support bracket of the pillar. The profile of the beam can be rectilinear or curved.

In the case where the beam is rectilinear, the pivots of the different modules are aligned along a line arranged in the longitudinal direction of the profile.

In the case where the beam is curved, its radius of curvature is a function of the angle of entry or exit of the cable.

The invention applies to all types of people movers, in particular chairlifts, gondola lifts, or aerial cable cars.

BRIEF DESCRIPTION OF THE DRAWINGS

Other advantages and features will become more clearly apparent from the following description of an embodiment of the invention given for non-restrictive example purposes only and represented in the appended drawings, in which.

DESCRIPTION OF A PARTICULAR EMBODIMENT

Figure 1:
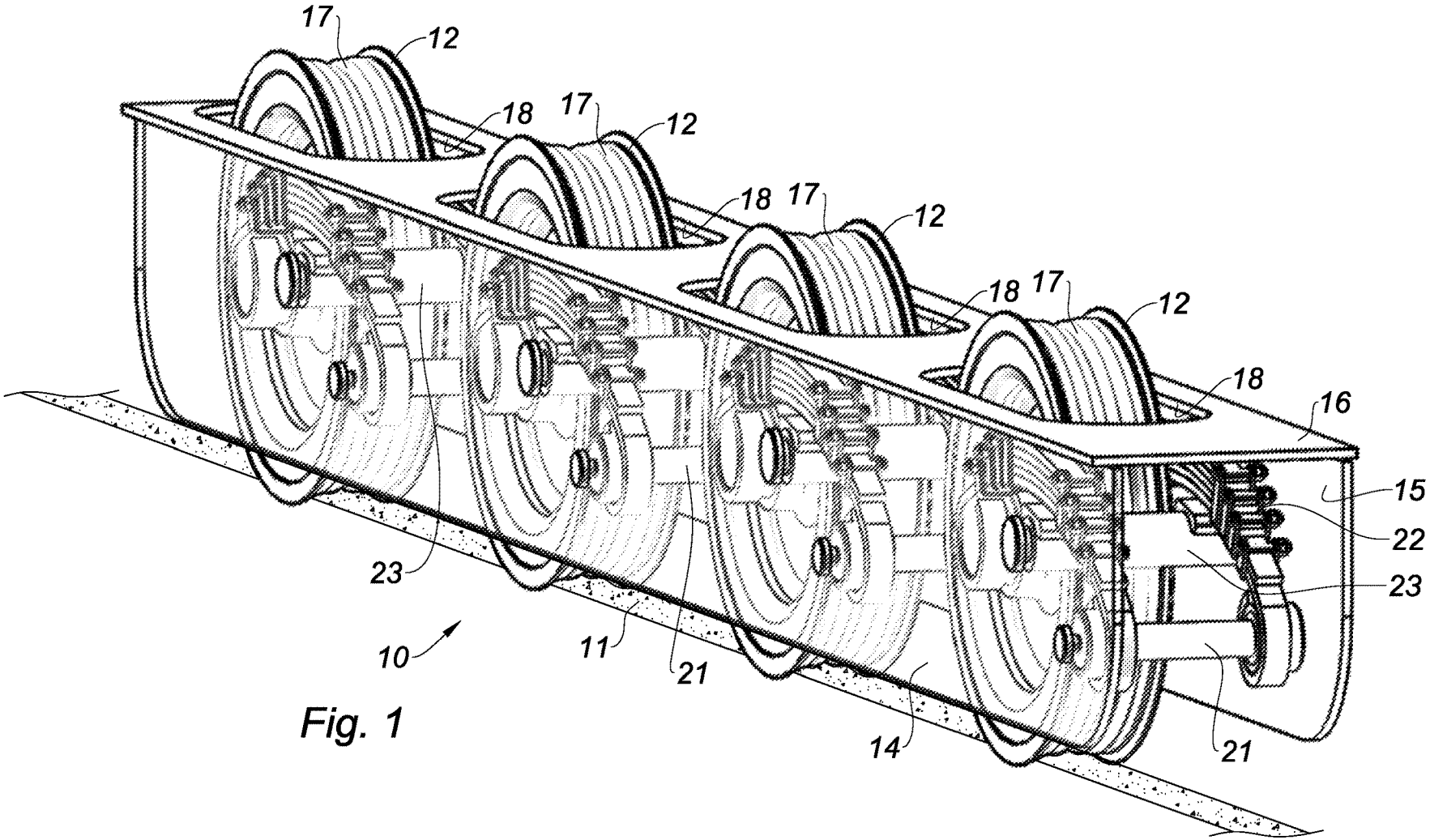
FIGS. 1 and 2 are perspective views of the device for supporting and guiding according to the invention, the cable being illustrated in FIG. 1 only.
Figure 2:
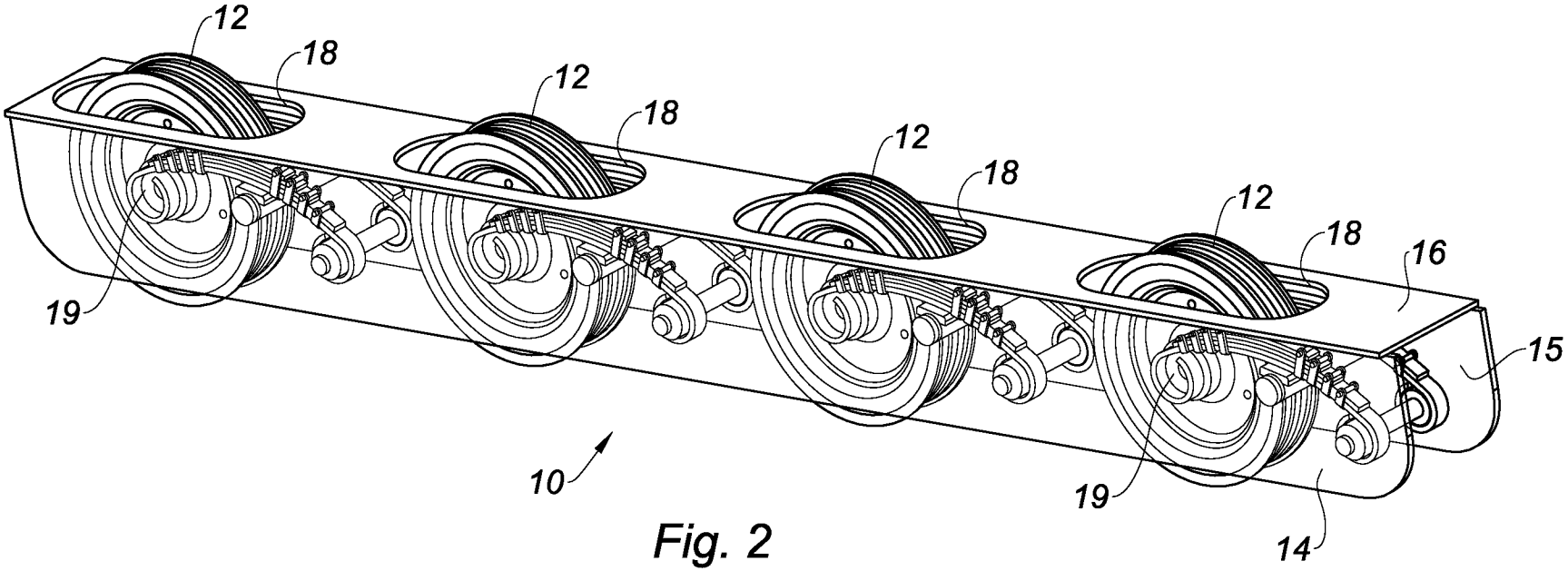
Figure 3:
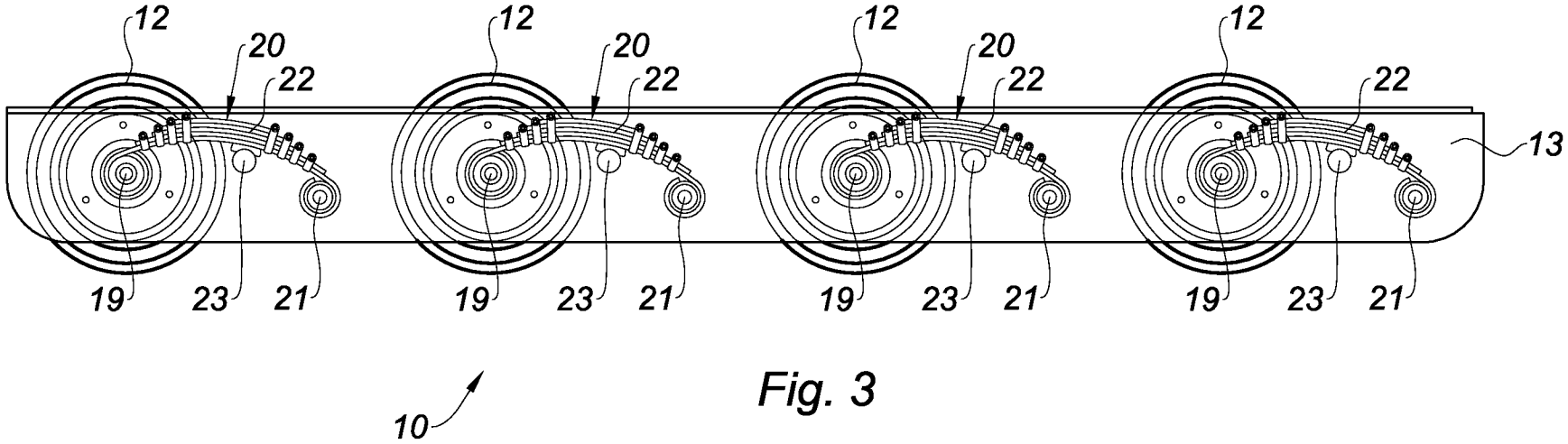
FIG. 3 shows an elevation view of FIG. 2, the beam having a rectilinear profile.

With reference to FIGS. 1 to 3, a device 10 for supporting and guiding an aerial carrying-hauling cable 11 of a cable lift installation comprises several sheaves 12 arranged at regular intervals along a support structure formed by a support beam 13.

The beam 13 is formed for example by a rectilinear profile having an reverse U-shaped transverse cross-section delimited by two vertical wings 14, 15 extending parallel to one another and joined to a common web 16 arranged at the top part of the beam 13. The sheaves 12 have identical structures with the same external diameters, each circular sheave 12 presenting a groove 17 on its periphery for guiding the aerial cable. The web 16 is provided with openings 18 allowing partial passage of the sheaves 12.

Each sheave 12 is mounted rotating freely around a first axis 19 located at one of the ends of a damping connection 20 arranged between the two wings 14, 15 inside the profile. The other end of the connection 20 is articulated around a transverse pivot 21 securely attached to the two wings 14, 15.

The damping connection 20 of each sheave 12 comprises a pair of leaf springs 22 located symmetrically on each side of the sheave 12. Each spring 22 extends in the longitudinal direction of the profile and is attached via its opposite ends respectively to the first axis 19 and to the pivot 21. The intermediate part of the springs 22 presses on a fixed second axis 23 which is securely attached to the two wings 14, 15 and extends parallel to the pivot 21. The second axis 23 is placed above a line passing through the first axis 19 and the pivot 21.

Each sheave 12 and its damping connection 20 with springs 22 forms an individual module fixed individually to the beam 13. The rotary sheave 12 of each module is able to pivot around the corresponding pivot 21, being permanently biased by the springs 22 into contact with the cable 11 with a predefined pressure. The pivoting movement of each module describes an acute angle which is a function of the load exerted by the cable and of the reaction of the springs 22.

The dampened sheaves 12 of the different modules thereby make it possible to adjust to the deflection of the carrying-hauling cable and to limit vibratory phenomena. The pressure exerted by the sheaves 12 is calculated to prevent any risk of derailment of the cable. In the example illustrated in FIGS. 1 to 3, the beam 13 of the device 10 for supporting and guiding is rectilinear and comprises four individual modules. The pivots 21 of the different modules are aligned along a straight line directed in the longitudinal direction of the profile. It is clear that the number of modules can be less than or more than four.

Figure 4:
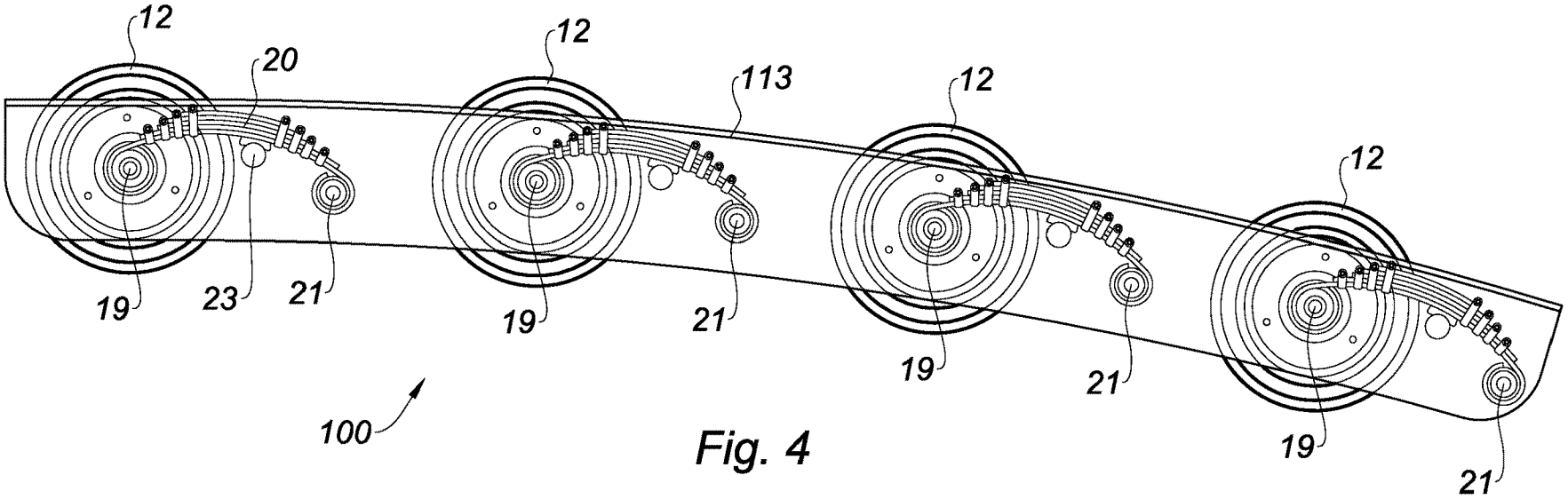
FIG. 4 is an alternative embodiment with a curved beam.

In the variant of the device 100 for supporting and guiding of FIG. 4, the same reference numerals designate identical or similar parts to those of the device 10 of FIGS. 1-3. The shape of the beam 100 is slightly curved and presents a predefined radius of curvature according to the angle of entry and exit of the cable. The pivots 21 are arranged along a path preferably having the same radius of curvature as the beam 100.

In both devices 10, 100, the middle part of the beam 13, 113 can be mounted fixed or articulated on a support bracket, in particular of a line pillar or of a terminal.

The leaf springs 22 of the damping connections 20 can be replaced by other types of springs or by gas or hydraulic cylinders.

Such an arrangement of the individual sheave modules 12 on the beam 13 enables maintenance costs to be reduced while avoiding having to perform complete disassembly of the device 10, 100 in case of a general overhaul or inspection of the installation. The modules will be able to be inspected individually on the maintenance platform of each pillar and the defective module be replaced without removing the device 10, 100 from its support bracket. The time required for performing troubleshooting and maintenance is reduced and simplified compared with the conventional technology using sheave assemblies.

The invention claimed is:

1. Device for supporting and guiding an aerial carrying-hauling cable of a cable lift installation, said device comprising:

a support structure, a plurality of rotary sheaves designed to guide and to press on the cable when the cable is running, and damping connections connected with the sheaves to adjust to the deflection and load of the cable, each rotary sheave being associated with a damping connection articulated around a pivot to form an individual module fixed individually to the support structure, and the different individual modules being staggered along the support structure in the form of a beam, the damping connection of each module comprising a pair of leaf springs located symmetrically on each side of the sheave, wherein the support structure comprises a profile of reverse U-shaped transverse cross-section having two vertical wings parallel to one another so as to delimit a compartment for housing the different individual modules, and wherein the sheave of each module is mounted rotating, freely around a first axis on one of the ends of the corresponding damping connection, the other end of said connection being articulated on the pivot, which is fixed transversely to the two wines of the profile.

2. Device for supporting and guiding according to claim 1, wherein each spring extends in the longitudinal direction of the support structure.

3. Device for supporting and guiding according to claim 1, wherein an intermediate part of each leaf spring presses on a second fixed axis which is parallel to the pivot.

4. Device for supporting and guiding according to claim 3, wherein the second axis is placed above a line passing through the first axis and the pivot.

5. Device for supporting and guiding according to claim 1, wherein the profile of the support structure is rectilinear, the pivots of the different modules being aligned along a line arranged in the longitudinal direction of the profile.

6. Device for supporting and guiding according to claim 1, wherein the profile of the support structure has a curved shape presenting a predefined radius of curvature according to the angle of entry or exit of the cable.

7. Device for supporting and guiding according to claim 1, wherein the support structure equipped with the different modules is mounted fixed or articulated on a support bracket or pillar of the installation.

* * * * *